US009990913B2

(12) United States Patent
Zintel et al.

(10) Patent No.: US 9,990,913 B2
(45) Date of Patent: Jun. 5, 2018

(54) METHOD OF GENERATING A DRIVE SIGNAL FOR A LOUDSPEAKER ARRANGED IN A MOTOR VEHICLE, AN EXHAUST SYSTEM FOR AN ENGINE AND A SOUND SYSTEM FOR A PASSENGER CELL

(71) Applicant: Faurecia Emissions Control Technologies, Germany GmbH, Augsburg (DE)

(72) Inventors: Gerhard Zintel, Nuremberg (DE); Martin Unbehaun, Nuremberg (DE)

(73) Assignee: Faurecia Emissions Control Technologies, Germany GmbH, Augsburg (DE)

( * ) Notice: Subject to any disclaimer, the term of this patent is extended or adjusted under 35 U.S.C. 154(b) by 0 days. days.

(21) Appl. No.: 15/404,306

(22) Filed: Jan. 12, 2017

(65) Prior Publication Data

US 2017/0206883 A1 Jul. 20, 2017

(30) Foreign Application Priority Data

Jan. 14, 2016 (DE) ..... 10 2016 100 542

(51) Int. Cl.
*G10K 11/178* (2006.01)
*F01N 1/06* (2006.01)

(52) U.S. Cl.
CPC ..... *G10K 11/1788* (2013.01); *F01N 1/065* (2013.01); *G10K 2210/12822* (2013.01);
(Continued)

(58) Field of Classification Search
CPC ..... F01N 1/065; G10K 2210/3014; G10K 2210/12822; G10K 2210/3025; G10K 2210/3046; G10K 11/1788
See application file for complete search history.

(56) References Cited

U.S. PATENT DOCUMENTS 5,571,239 A 11/1996 Kameda et al.
5,748,748 A 5/1998 Fischer et al.
(Continued)

FOREIGN PATENT DOCUMENTS

DE 102005052335 A1 9/2006
GB 2254979 A 10/1992
GB 2378081 A 1/2003

OTHER PUBLICATIONS

Summary of the Office Action issued by the German Patent and Trademark Office dated Oct. 20, 2016.

*Primary Examiner* — Brenda C Bernardi
(74) *Attorney, Agent, or Firm* — Carlson, Gaskey & Olds, P.C.

(57) ABSTRACT

A method of generating a drive signal for a loudspeaker in an exhaust system of an engine of a vehicle or inside or outside a passenger cell includes providing a predetermined source signal for a desired additional sound in a time domain comprising a plurality of signal components of different frequencies; analyzing the source signal based on a phase of the source signal and/or a phase of at least one oscillation in the source signal; identifying a phase of engine noise and/or a phase of at least one oscillation existing in engine noise; shifting the phases of the source signal and/or the oscillation existing in the source signal based on phases identified in engine noise and/or in oscillation existing in engine noise, the relationship of phases of individual oscillations of the source signal among each other being preserved; and generating the drive signal based on the phase-shifted source signal.

20 Claims, 5 Drawing Sheets

(52) U.S. Cl.
CPC ..... *G10K 2210/3014* (2013.01); *G10K 2210/3025* (2013.01); *G10K 2210/3046* (2013.01)

(56) References Cited

U.S. PATENT DOCUMENTS

| | | | | | |
|---|---|---|---|---|---|
| 5,828,759 | A * | 10/1998 | Everingham | G10K 11/1788 | 181/206 |
| 5,917,919 | A * | 6/1999 | Rosenthal | G10K 11/1786 | 381/71.11 |
| 2013/0108067 | A1 | 5/2013 | Schumacher et al. | | |
| 2013/0142352 | A1* | 6/2013 | Koch | H04R 1/22 | 381/86 |
| 2015/0170629 | A1 | 6/2015 | Christoph | | |
| 2015/0255054 | A1* | 9/2015 | Keck | G10H 5/10 | 381/61 |
| 2017/0234179 | A1* | 8/2017 | Petley | F01N 1/065 | 381/71.1 |
| 2017/0234180 | A1* | 8/2017 | Petley | F01N 1/065 | 381/71.1 |

* cited by examiner

METHOD OF GENERATING A DRIVE SIGNAL FOR A LOUDSPEAKER ARRANGED IN A MOTOR VEHICLE, AN EXHAUST SYSTEM FOR AN ENGINE AND A SOUND SYSTEM FOR A PASSENGER CELL

CROSS-REFERENCE TO RELATED APPLICATIONS

This application claims priority to DE 10 2016 100 542.8, filed Jan. 14, 2016.

FIELD OF THE INVENTION

The invention relates to a method of generating a drive signal for a loudspeaker arranged in a motor vehicle, in particular in an exhaust system of the engine of the vehicle or inside or outside a passenger cell, an exhaust system provided for an engine and including a loudspeaker as well as to a sound system for a passenger cell.

BACKGROUND

Engine exhaust systems comprising a loudspeaker and methods of generating a drive signal for this loudspeaker are known. They are used, for example, in vehicles comprising a combustion engine and serve for adapting the noise emitted from the combustion engine to the surroundings. This allows to build the sound of an engine in the surroundings of the vehicle. In doing so, an amplification or an alteration of the engine noise as well as a reduction of the engine noise can be achieved. It is also known to play back the engine noise into the interior of the vehicle via loudspeakers in order to be able to build the sound of an engine in the passenger cell as well.

The loudspeaker is usually driven by a drive signal such that it generates a noise which resembles that of an engine, in the following referred to as an additional sound. The additional sound is superimposed in the exhaust system or the passenger cell to the engine noise, generating the sound of the engine which is emitted to the surroundings or perceived by the occupant.

The drive signal for the loudspeaker is designed here such that the sound of the engine emitted to the surroundings or perceived by the occupants is pleasant and adapted to the respective car. As a rule, a predefined source signal is used as the drive signal corresponding to the driving situation or the current operating parameters of the engine such as the rotational speed, said source signal consisting of a sequence of samples, for instance.

However, a free sound configuration of the engine sound, such as the reproduction of measured sounds, a free variation of the spectra over the rotational speed and load of the engine, is not possible here. It is likewise not possible to combine these source signals with an anti-sound function in which the noise of the engine is reduced by sound waves generated by the loudspeaker which are opposite in phase.

It is the object of the invention to provide a method of generating a drive signal as well as an exhaust system which allows a free sound configuration of the engine sound on the basis of a predetermined source signal as well as the use of the source signal with an anti-sound function of the exhaust system.

SUMMARY

The present invention provides a method of generating a drive signal for a loudspeaker arranged in a motor vehicle, in particular in an exhaust system of the engine of the vehicle or inside or outside a passenger cell, comprising the following steps: providing a predetermined source signal for a desired additional sound in a time domain, the source signal comprising a plurality of signal components of different frequencies; analyzing the source signal with respect to a phase of the source signal and/or a phase of at least one oscillation existing in the source signal; identifying a phase of the engine noise and/or a phase of at least one oscillation existing in the engine noise; shifting the phase of the source signal and/or the phase of the at least one oscillation existing in the source signal as a function of the phase as identified of the engine noise and/or of the phase as identified of the at least one oscillation existing in the engine noise, the relationship of the phases of the individual oscillations of the source signal among each other being preserved; and generating the drive signal on the basis of the phase-shifted source signal.

The term "predetermined" means in this context that the source signal is either fixed in factory or has been generated in a preceding step as a function of the driving situation, the driver's wishes and/or at least one operating parameter of the engine, such as the rotational speed or load for example. In particular, the source signal is precisely not a signal of the current exhaust gas noise or the like, recorded by a microphone in real time. In case the source signal is fixed in factory, several different source signals are provided, one among these being selected as a function of the driving situation, the driver's wishes or at least one operating parameter of the engine, such as the rotational speed or load for example.

In this connection, the signal components of the source signal themselves may be oscillations of a specific frequency which are superimposed to produce the source signal. It is also possible that the signal components are very short sections of an oscillation of a specific frequency, for instance having the length of one period, which result in the source signal when arranged one after the other, i.e. when sequentially arranged. The source signal may also be a mixture of these two methods, and a signal component of an oscillation may be superimposed, for instance, on a source signal comprising sequential signal components.

The invention allows to add an additional sound, which is adapted in phase to the engine noise and defined by a predetermined source signal, to the engine noise for generating the desired sound of the engine, without any alteration of the desired additional sound in the course of the necessary adaptation of the source signal. This allows to exert a targeted influence on the sound of the engine by the source signal, and thus the engine sound can be freely designed or the source signal may be output to be opposite in phase in order to realize an anti-sound function of the exhaust gas systems and/or inside or outside the passenger cell. The synchronization of the phases of the source signal and the engine signal also allows to guard against unexpected and undesired beats or extinctions during the superimposing of the desired additional sound and the engine noise.

Preferably, the signal components of the source signal, the oscillation existing in the source signal and/or the oscillation existing in the engine noise are harmonic oscillations of one of the engine orders, in particular a multiple of the 0.5th engine order, so that the adaptation of the desired engine sound is effected on the basis of the engine orders, improving the control of the engine sound and the impression of a noise naturally generated by the engine.

Here, the 0.5th engine order has the frequency of half the rotary frequency of the engine. This is why the frequencies of the engine orders and hence the frequencies of the signal components or oscillations correspondingly increase with an increasing rotational speed.

For shifting the phases, for instance, a preferred engine order is intended, with the phase of the oscillation of the source signal corresponding to this preferred engine order and the phase of the oscillation of the engine noise corresponding to this preferred engine order being correspondingly adapted to each other, in particular equated. Here, the engine order having the highest level, i.e. the loudest engine order, may be used as the preferred engine order. In this way, the superposition of the desired additional sounds on the engine noise is further improved.

It is also possible that the phase of an oscillation, corresponding to one and/or the preferred engine order, of the source signal and the phase of the oscillation, corresponding to this one and/or the preferred engine order, of the engine noise are offset by 180 degrees relative to each other. In this way, oscillations are produced which are opposite in phase and eliminate each other, thus reducing the engine noise for the adapted order or as a whole.

In a preferred embodiment, the shifting of the phases of the source signal is carried out in the frequency domain, allowing a precise adaptation of the phases. The drive signal can subsequently be generated by a retransformation of the phase-shifted source signal. Of course, the amplitudes of the oscillations initially existing in the source signal are taken into consideration as well.

Preferably, the analyzing of the source signal is carried out by a transformation to the frequency domain, in particular by a Fourier transform or a fast Fourier transform (FFT), allowing a fast and reliable analysis of the phases in the frequency domain.

By way of example, the phase of the engine noise and/or the phase of the at least one oscillation existing in the engine noise is determined in the frequency domain, in particular by a Fourier transform or a fast Fourier transform (FFT) and/or on the basis of sensor data. This makes it possible to determine the phases of the engine noise and the oscillations existing therein in a quick and reliable manner. In this context, the term "sensor data" is also meant to comprise data which is produced by the engine control system and is not based on measured values of a sensor.

In a variant of an embodiment, the source signal comprises signal components which consist of a signal picked up before, which allows to use the engine noise of a real engine. This may result in a significant reduction of the expenditure for generating the source signal.

In one embodiment of the invention, the source signal comprises synthetically generated signal components, in particular sinusoidal tones, so that the source signal may be freely modified.

In a further embodiment of the invention, the level of an oscillation existing in the source signal is reduced if the frequency $\omega$ of this oscillation is close to the frequency $\omega_R$ of an undesirable resonance. This situation may occur during revving up the engine, if the frequency $\omega$ of the least one oscillation of the source signal depends on the engine speed. In that case, the frequency $\omega$ of this oscillation increases together with the engine speed, so that its frequency $\omega$ for certain engine speeds is close or equal to the frequency $\omega_R$ of an undesired resonance. An undesired resonance is for instance a vibration of the body or of a body panel of the vehicle in which the exhaust system is installed. This allows to prevent an undesired noise generation.

The source signal preferably has an effective value of the voltage of at least 50%, preferably at least 80% of the maximum voltage of the loudspeaker. An appropriate selection and design of the source signal allows to generate such effective values which increase the perceived volume of the desired additional sound. Such a design of the predetermined source signal is only possible, however, in that the mutual relations of the phases of the individual signal components of the source signal are preserved during the shifting of the phases.

The object is further achieved by an exhaust system for an engine, in particular of a motor vehicle, comprising a loudspeaker and a controller, the controller being configured to carry out the above method and to drive the loudspeaker by the drive signal. Such an exhaust system allows to design the sound of the engine emitted to the surroundings.

The exhaust system preferably includes an exhaust branch and a microphone, the loudspeaker being in fluidic contact with the exhaust branch at a contact point, and the microphone being arranged upstream or downstream of the contact point, which makes it possible to record and analyze the engine noise. Here, the term "upstream" and "downstream" refer to the flow direction of the exhaust gas.

The object is further achieved by a sound system for a passenger cell of a motor vehicle comprising at least one loudspeaker and a controller, the controller being configured to carry out the above method and to drive the loudspeaker by the drive signal. By using such a sound system, a desired engine sound can be generated in the passenger cell.

Preferably, the sound system is part of a stereo and/or entertainment system of the vehicle, allowing to reduce costs, as the loudspeakers of the stereo and/or entertainment system may also be used for the sound system.

These and other features may be best understood from the following drawings and specification.

DETAILED DESCRIPTION

Figure 1:
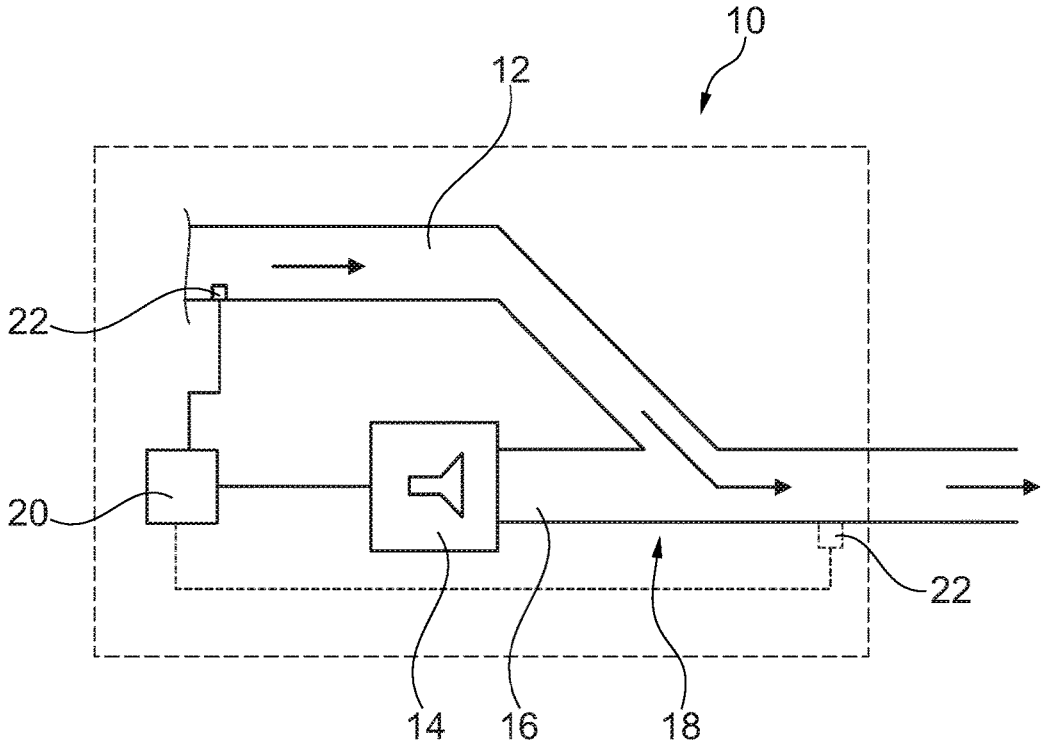
FIG. 1 schematically shows an exhaust system according to the invention, carrying out the method of the invention.

FIG. 1 schematically shows an exhaust system 10 according to the invention for a combustion engine. The exhaust system 10 is, for example, part of a vehicle 11 (FIG. 8) comprising a combustion engine.

The exhaust system 10 comprises an exhaust branch 12 through which the exhaust gas of the engine (not shown) flows. The flow direction of the exhaust gas is indicated by arrows.

The exhaust system 10 further comprises a loudspeaker 14 which is fluidically connected to the exhaust branch 12, for instance by a bridge portion 16 opening into the exhaust branch 12 at a contact point 18. In FIG. 1, the contact point 18 is situated within the exhaust system 10. It is also conceivable, however, that the bridge portion 16 and the exhaust branch 12 extend so as to be separate from each other and open into the surroundings close to each other, so that the contact point 18 is in the immediate surrounding of the vehicle itself.

The exhaust system 10 further comprises a controller 20 which is connected to the loudspeaker 14 and drives the loudspeaker 14 by a drive signal. The loudspeaker 14 then converts this drive signal into sound waves which are emitted into the bridge portion 16.

Furthermore, a microphone 22 may be provided in the exhaust branch 12 upstream of the contact point 18 with regard to the flow of the exhaust gas, the microphone being connected to the controller 20.

It is also conceivable to provide the microphone 22 downstream of the contact point 18, as indicated in FIG. 1 by broken lines.

With the aid of the signal from the microphone 22, the controller 20 is able to analyze the engine noise existing in front of the contact point 18.

The controller 20 may be connected to further sensors and/or the engine control system in order to receive data therefrom.

In the embodiment as shown, the controller 20 is formed as a separate component, but it may also be integrated in the engine control system.

The drive signal for the loudspeaker 14 is generated by the controller 20. A source signal 24 forms the starting point of the generation of the drive signal.

Figure 2:
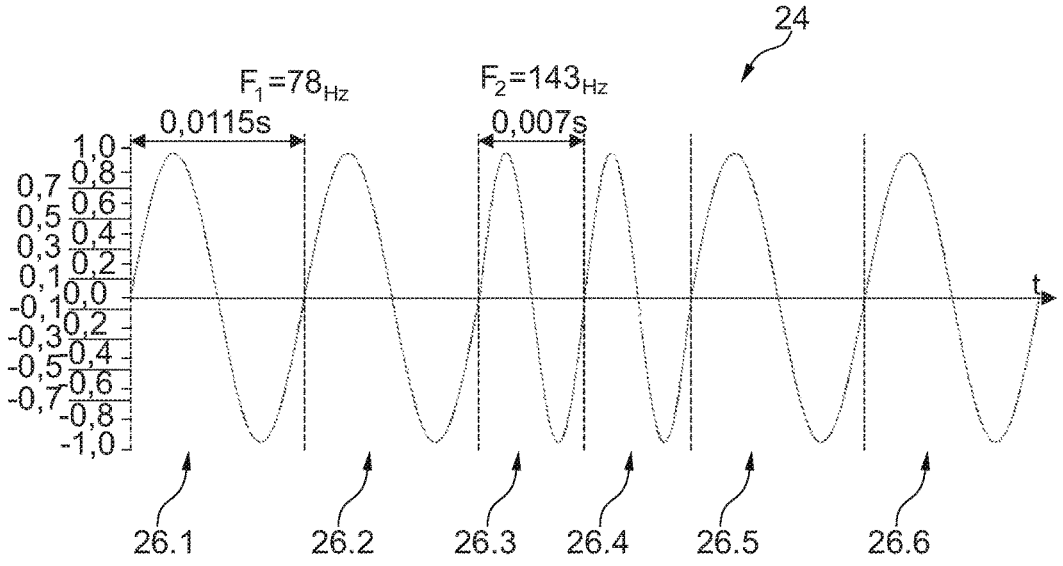
FIG. 2 shows a part of an source signal, used in the method according to the invention, in the time domain.

A short temporal part of a possible embodiment of a source signal 24 in the time domain is illustrated in FIG. 2.

In the event of playback, the source signal 24 already generates a noise which resembles the sound of an engine and is referred to as an additional sound in the context of the invention. The additional sound is superimposed on the engine noise in the exhaust system 10. The source signal 24 is predetermined such that—when the additional sound is superimposed on the engine noise—the desired sound of the engine is created in the surroundings of the vehicle.

The source signal 24 is selected from a plurality of defined source signals as a function of the driving situation, the driver's wishes and/or current operating parameters of the engine such as the rotational speed or the load, or the source signal is generated depending on the driving situation, the driver's wishes and/or current operating parameters of the engine.

In particular, the source signal 24 is not provided by arranging a microphone in the exhaust branch which records the exhaust gas noise or another noise in real time.

In the embodiment shown in FIG. 2, the source signal 24 is composed of various signal components 26.1 to 26.6 which are sequentially arranged, i.e. so as to be subsequent to each other.

The signal components 26.1 to 26.6 represent oscillations of different frequencies. The duration of a signal component 26.1 to 26.6 is very short, for instance only one period of the corresponding oscillation.

The signal components 26.1 to 26.6 represent one period of a sinusoidal tone, for example. It is also conceivable, however, that the signal components 26.1 to 26.6 or the entire source signal 24 consist of signals recorded beforehand.

In the source signal 24 shown in FIG. 2, the signal components 26.1, 26.2, 26.5 and 26.6 each represent one period of an oscillation with a first frequency $f_1$ and the signal components 26.3 and 26.4 each represent one period of an oscillation having a second frequency $f_2$.

By way of example, the first frequency $f_1$ is equal to 78 Hertz and the second frequency $f_2$ is equal to 143 Hertz, so that the signal components 26.1, 26.2, 26.5 and 26.6 each have a duration of 0.0115 seconds and the signal components 26.3 and 26.4 each have a duration of 0.007 seconds.

The amplitudes of the signal components 26.1 to 26.6 are all of the same size, which may be advantageous also with signal components having frequencies other than those mentioned above. It goes without saying that these amplitudes may also be chosen so as to be different.

The source signal 24 may be a repetition of the section illustrated in FIG. 2 or may also be any other suitable sequence of these and/or further signal components 26.1 to 26.6.

Apart from the frequencies $f_1$, $f_2$ of the signal components 26.1 to 26.6, the predetermined source signal 24 generated in this way comprises further oscillations 28 of other frequencies. This is due to the fact that the individual signal components 26.1 to 26.6 are very short and last for only one period in this case; the source signal 24 itself, however, which is composed from these, is longer by several orders of magnitudes.

The source signal 24 is now analyzed by the controller to the effect that the phase of the source signal 24 and/or the phase of at least one oscillation 28 existing in the source signal 24 is determined.

By way of example, this is carried out by a transformation of the source signal 24 to the frequency domain, e.g. by a Fourier transform or a fast Fourier transform (FFT).

Figure 3:
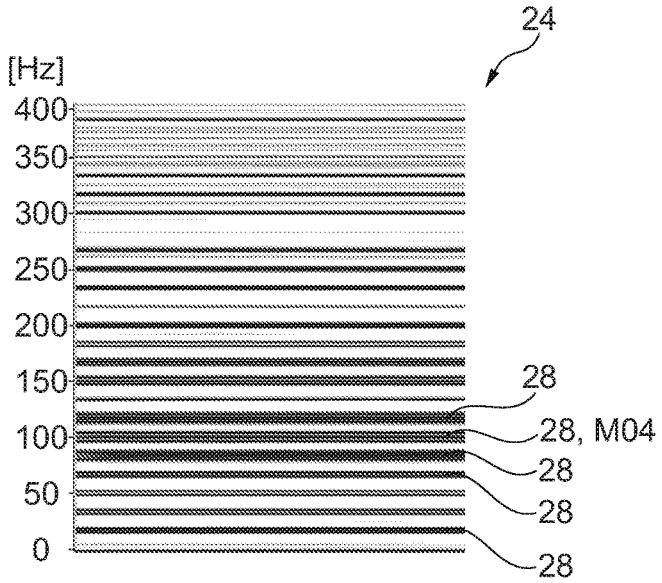
FIG. 3 is an illustration of the source signal according to FIG. 2 in the frequency domain.

FIG. 3 illustrates the source signal 24 in the frequency domain, but without any phase information for the sake of clarity. Not all of the oscillations 28 are provided with reference symbols. Now, the individual oscillations 28 can be identified and their phase can be determined in the frequency domain.

The source signal 24 is designed such, for instance, that the frequencies of the oscillations 28 are multiples of half the rotary frequency of the engine, the oscillations 28 thus being multiples of the 0.5th engine order.

In a next step, an engine noise 30 (FIG. 4) likewise comprising several oscillations 32, is analyzed by the controller 20.

Figure 4:
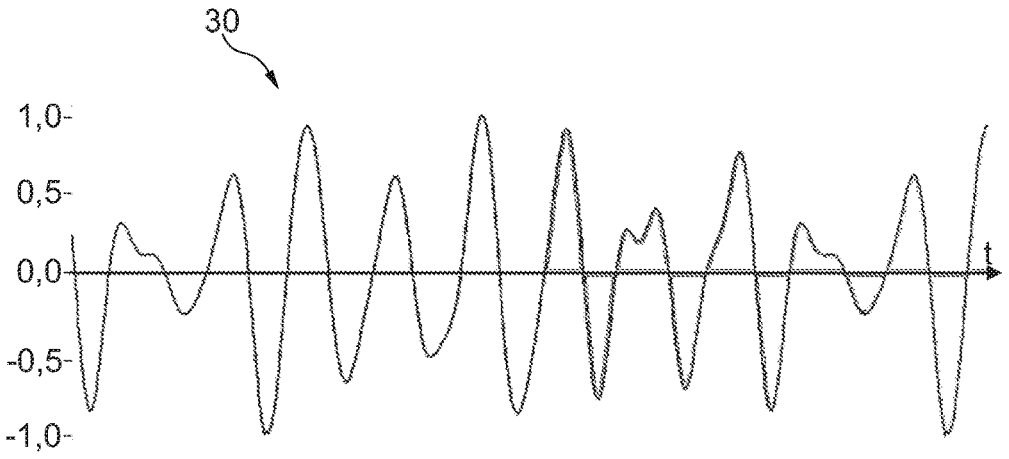
FIG. 4 shows a part of an engine noise in the time domain.

FIG. 4 illustrates a part of an engine noise 30 in sections with respect to time, i.e. in the time domain. This signal is recorded by the microphone 22, for example, and transmitted to the controller 20.

The engine noise 30 is analyzed by the controller 20 as well, and the phase of the engine noise 30 and/or the phase of at least one oscillation 32 (FIG. 5) existing in the engine noise 30 is determined.

This may also be carried out via a transformation of the engine noise 30 to the frequency domain, in particular by a Fourier transform or a fast Fourier transform (FFT).

As a further measure or as an alternative, the phase of the engine noise 30 and/or the phase of at least one oscillation 32 existing in the engine noise 30 can be determined by the controller 20 with the aid of the data from the sensors and/or the data transmitted from the engine control system to the controller 20.

By way of example, the controller 20 receives from the engine control system information about the rotational speed of the engine and/or about the phase of the engine related to the upper dead center of the first cylinder, from which the controller 20 determines the phase of the engine noise 30 and/or the phase of at least one oscillation 32 existing in the engine noise 30.

Figure 5:
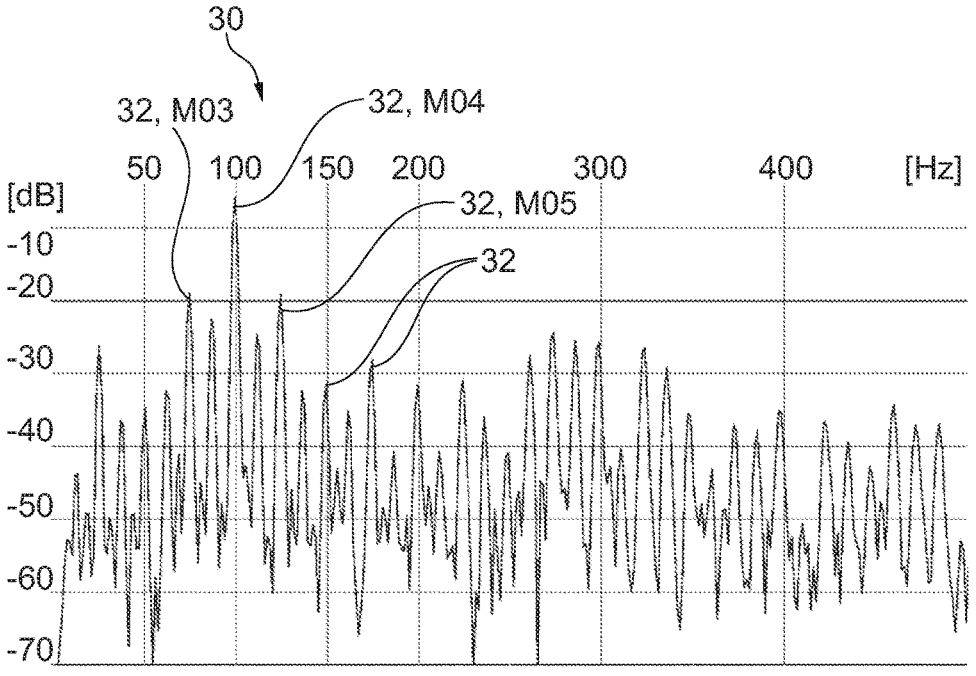
FIG. 5 shows a part of another engine noise in the frequency domain.

FIG. 5 is an illustration of an engine noise 30 in the frequency domain. Here too, an illustration of the various phases has been omitted for reasons of clarity, and not all of the oscillations 32 are provided with a reference symbol.

It can be seen clearly, however, that some oscillations 32 in the engine noise 30 are particularly well pronounced. These oscillations 32 correspond to the harmonic oscillations of the engine orders or ignition orders of the engine and are referred to in the following as "engine orders". Here, the 0.5th engine order has the frequency equal to half the rotary frequency of the engine. This is why the frequencies of the engine orders and hence the frequencies of the oscillations 28 of the source signal 24 and of the signal components 26.1 to 26.6 correspondingly increase with an increasing rotational speed of the engine.

With the engine noise 30 illustrated in FIG. 5, the 4th engine order MO4 with a frequency of 100 Hertz has the highest level and thus is particularly present. The 3rd engine order MO3 and the 5th engine order MO5 with a frequency of approximately 75 and 125 Hertz, respectively, are very pronounced as well. The phase of at least one of these engine orders MO3, MO4, MO5 is determined by the controller 20.

In the next step, the source signal 24 is adapted to the engine noise 30, with a phase shifting being performed on the source signal 24.

A preferred engine order MO3, MO4, MO5 may be selected as the reference point of the phase shift. The engine order with the highest level, in this case the 4th engine order MO4 would be suitable here, for example. However, it is also conceivable to select another preferred engine order.

An oscillation 28 in this preferred engine order, here the 4th engine order MO4 with 100 Hertz, can also be found in the source signal 24, which in FIG. 3 is also referred to as MO4. The phase of this oscillation 28, corresponding to the 4th engine order MO4, of the source signal 24 is now shifted such that it is adapted to the phase of the oscillation 32 of the 4th engine order MO4 of the engine noise.

The adaption is carried out such that, for instance, the oscillations 28, 32 of the 4th engine order MO4 have the same phase both in the source signal 24 and in the engine noise 30, i.e. the phases being equated and the oscillations 28, 32 reinforcing each other.

It is also conceivable, however, that the phase of the oscillation 28 of the 4th engine order MO4 of the source signal 24 is adapted in such a manner that it is opposite in phase with respect to the oscillation 32 of the 4th engine order of the engine noise 30, so that the oscillations cancel each other and an attenuation of the engine noise 30 is provoked.

The phase shift of the source signal 24 can be carried out here already in the frequency domain.

In shifting the phase of the oscillation 28 of the preferred engine order of the source signal 24, also the phases of the remaining oscillations 28 of the source signal 24 are shifted by the same amount, so that a fixed phase relation of the individual oscillations 28 and hence of the individual signal components 26.1 to 26.6 is maintained. In this way, it is ensured that the form of the source signal 24 does not change in the time domain, which means that the desired additional sound is not altered by the phase shift.

Subsequently, a drive signal for the loudspeaker 14 is generated from the source signal 24 which is now shifted in phase, for instance by a retransformation from the frequency domain to the time domain. This may also be carried out by the controller 20.

The oscillations' 28 amplitudes existing in the source signal 24 prior to the adaptation are maintained here as a rule.

The loudspeaker 14 then converts the drive signal into sound waves, i.e. into the desired additional sound, and is superimposed at the contact point 18 on the engine noise 30, generating the desired engine sound.

An additional possibility of affecting the noise generation of the vehicle is to influence the level of the source signal 24 in a frequency-depending manner in order to suppress any undesired noise generation due to resonances in the vehicle.

It may happen that some panels of the body begin to vibrate on a vehicle if there are oscillations in the engine noise 30 or in the source signal 24 which have the resonant frequency $\omega_R$ of exactly these body panels. If, for instance, an engine order of the engine noise 30 or of the source signal 24 goes through the resonant frequency $\omega_R$ of a body panel at a specific engine speed, this body panel starts to vibrate.

For reducing these vibrations, the level or the amplitude of the oscillation 28 having the frequency $\omega_R$ and being present at that moment in the source signal 24 is reduced.

This situation may occur during revving up the engine, if the frequency $\omega$ of the at least one oscillation 28 of the source signal 24 depends on the engine speed. In this case, the frequency $\omega$ of this oscillation rises together with the engine speed, so that this frequency $\omega$ is close to such resonant frequencies $\omega_R$ for certain engine speeds. In this way, the oscillation 32 of the engine sound, causing an undesired vibration, is attenuated without impairing the other oscillations 28 of the source signal 24. Indeed, the signal of the additional sound changes in the time domain, but this is accepted for the suppression of the undesired body resonances.

It is further conceivable to determine the phase of the engine noise 30 and/or the phase of at least one oscillation 32 existing in the engine noise 30 in that the controller 20 makes recourse to sensor data, including data of an engine control system, in order to determine the engine noise 30, its phase or the phase of individual oscillations 32 or engine orders MO3, MO4, MO5 from these data.

It is also possible to shift the phase of an oscillation 28, corresponding to one engine order and/or the preferred engine order such as the third, fourth or fifth engine order MO3, MO4, MO5, of the source signal 24 in such a manner that it is offset from the phase of the oscillation 32, corresponding to said one and/or preferred engine order MO3, MO4, MO5, of the engine noise 30 by 180°. These oscillations 28, 32 are then opposite in phase and eliminate each other. This allows to selectively remove engine orders from the engine noise and to reduce the engine noise as a whole.

A second embodiment of a source signal 24 will be discussed in the following, the reference symbols being adopted in their meanings. In particular, reference is also made to the engine noise 30 according to FIGS. 4 and 5.

Figure 6:
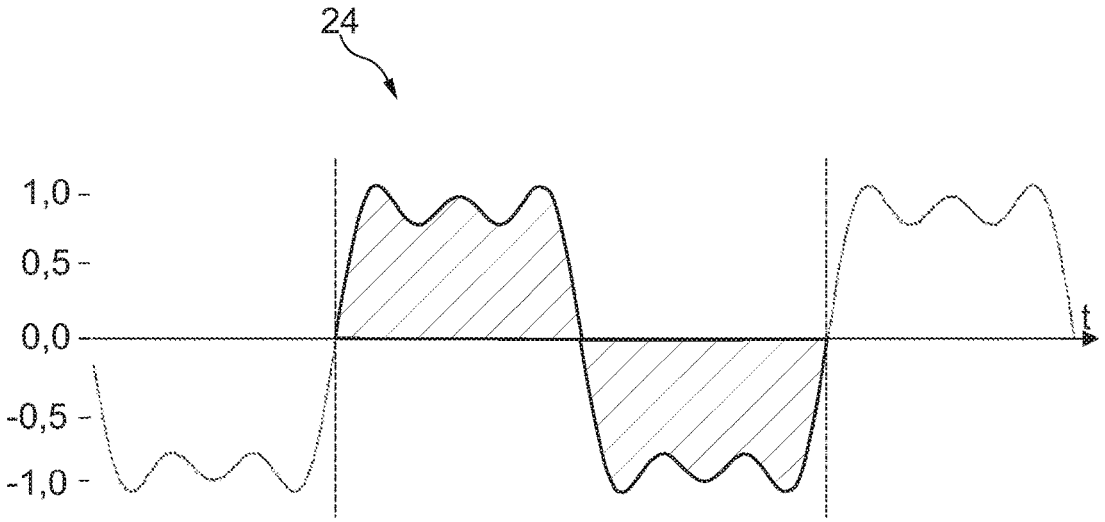
FIG. 6 shows a part of an source signal in the time domain, according to a second embodiment of the method according to the invention.

The source signal 24 of the second embodiment is illustrated in FIG. 6 in the time domain.

In this second embodiment, the signal components 26 are sinusoidal tones of different frequencies which are superimposed on each other.

Correspondingly, the signal components 26 simultaneously are the oscillations 28 existing in the source signal 24.

In the greatly simplified example which is shown in FIG. 6, the source signal 24 ($S_Q(t)$) consists, for example, of a superimposition of three sinusoidal oscillations according to following formula:

$$S_Q(t)=\sin(\omega t)+\tfrac{1}{3}\sin(3\omega t)+\tfrac{1}{5}\sin(5\omega t).$$

The source signal 24 shown in FIG. 6 has an effective value of the voltage which is larger than 50%, in particular larger than 80%, of the maximum voltage of the loudspeaker. In an illustrative way, the effective value may be understood as the surface area of the graph and is shown in hatched form in FIG. 6 for one period. The greatest possible effective value ensures that the loudspeaker is used for noise generation at the best, since a large effective value corresponds to a high perceived sound volume.

Steeper slopes and thus higher effective values can be achieved by the superposition of even more oscillations 28, for instance ten oscillations.

Figure 7:
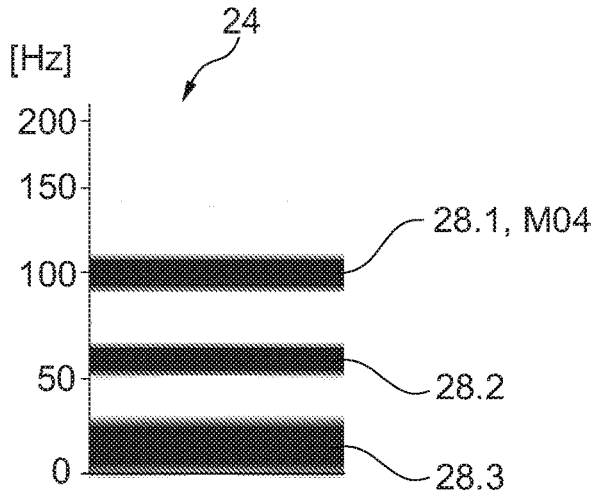
FIG. 7 is an illustration of the source signal according to FIG. 6 in the frequency domain, and FIG. 8 schematically shows in a perspective view a part of a motor vehicle comprising a sound system, according to the invention, for a passenger cell.

In the embodiment shown in FIG. 6, however, there are only three oscillations 28.1, 28.2, 28.3 for better clarity, as can be readily taken from the illustration of the source signal 24 in the frequency domain (FIG. 7).

The source signal of this embodiment also comprises an oscillation 28.1 with a frequency of 100 Hertz, i.e. an oscillation corresponding to the 4th engine order MO4.

The phase of said oscillation 28.1 of the 4th engine order MO4 can now be adapted to the phase of the oscillation 32 of the 4th engine order MO4 of the engine noise 30, as described above.

In particular in the case of an source signal 24 which has been designed in terms of a high effective value of the voltage, as with the source signal 24 of this second embodiment, it is of great importance that the phase relations of the oscillations 28.1, 28.2, 28.3 of the source signal 24 are preserved among each other. This allows to maintain the form and hence the high effective value of the voltage of the source signal 24 in the time domain.

It goes without saying that the source signals 24 of the first and second embodiment can be interchanged at will without affecting the advantages and functions of the method or of the exhaust system 10.

Figure 8:
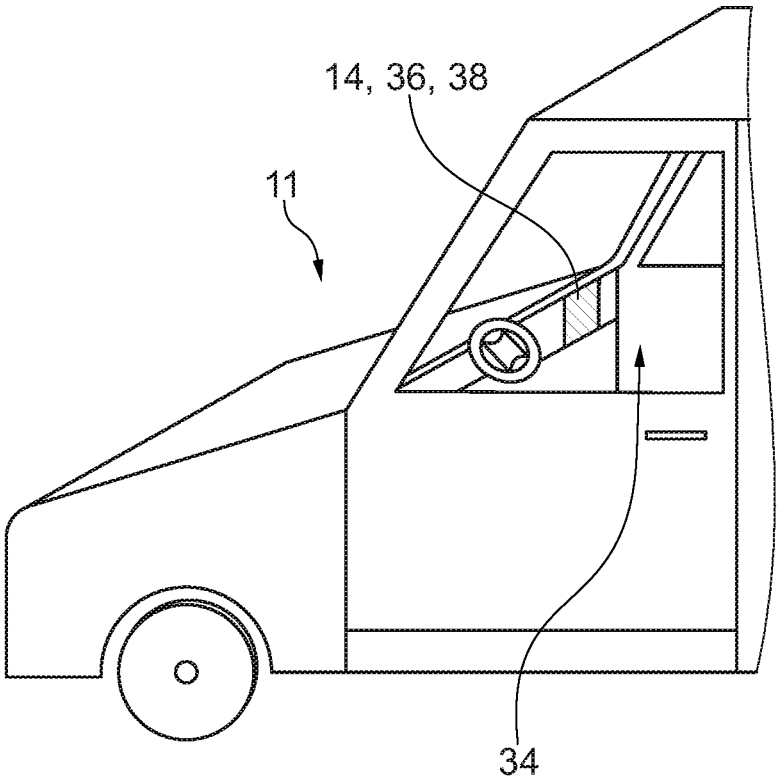

It is also conceivable to provide the loudspeaker 14 not in the exhaust system 10, but in a passenger cell 34 of the vehicle 11, as schematically shown in FIG. 8.

The loudspeaker 14 of this embodiment can be operated in analogy to the method explained above; in this case, however, the desired engine sound is not the sound emitted to the surroundings, but the sound of the engine perceived by the vehicle occupant in the passenger cell 34.

The loudspeaker 14 may also be part of a sound system 36 also comprising the controller 20.

In this arrangement, the loudspeaker 14 and/or the sound system 36 may be part of a stereo and/or entertainment system 38 of the vehicle 11.

It is conceivable, of course, to provide at least one loudspeaker 14 in the exhaust system 10 and at least one loudspeaker 14 in the passenger cell 34, in order to be able to build both the sound emitted to the surroundings as well as the sound perceived by the occupants.

In doing so, the drive signal for the loudspeaker 14 is indeed generated with the same method as described above, but the source signal 24 or the drive signal itself does not necessarily have to be the same for these two methods.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A method of generating a drive signal for a loudspeaker arranged in a motor vehicle, in particular in an exhaust system of the engine of the vehicle or inside or outside a passenger cell, comprising the following steps:

(a) providing a predetermined source signal for a desired additional sound in a time domain, the source signal comprising a plurality of signal components of different frequencies, (b) analyzing the source signal with respect to a phase of the source signal and/or a phase of at least one oscillation existing in the source signal, (c) identifying a phase of the engine noise and/or a phase of at least one oscillation existing in the engine noise, (d) shifting the phase of the source signal and/or the phase of the at least one oscillation existing in the source signal as a function of the phase as identified of the engine noise and/or of the phase as identified of the at least one oscillation existing in the engine noise to provide a phase-shifted source signal, a relationship of the phases of the individual oscillations of the source signal among each other being preserved, and (e) generating the drive signal on the basis of the phase-shifted source signal.

2. The method according to claim 1, wherein the oscillation existing in the engine noise and/or in the source signal is a harmonic oscillation of one of a plurality of engine orders.

3. The method according to claim 2, wherein the oscillation existing in the engine noise and/or in the source signal is a harmonic oscillation of a 0.5th engine order.

4. The method according to claim 2, wherein for shifting the phases, a preferred engine order is determined, the phase of the oscillation, corresponding to this preferred engine order, of the source signal and the phase of the oscillation, corresponding to this preferred engine order, of the engine noise are either adjusted to each other or equated.

5. The method according to claim 4, wherein the phase of an oscillation, corresponding to one and/or the preferred engine order, of the source signal and the phase of the oscillation, corresponding to this one and/or the preferred engine order, of the engine noise are offset by 180 degrees relative to each other.

6. The method according to claim 1, wherein the shifting of the phase of the source signal is carried out in a frequency domain.

7. The method according to claim 1, wherein the analyzing of the source signal is carried out by a transformation to a frequency domain.

8. The method according to claim 7, wherein the analyzing of the source signal is carried out by one of a Fourier transform or a fast Fourier transform (FFT).

9. The method according to claim 1, wherein the phase of the engine noise and/or the phase of at least one oscillation existing in the engine noise is identified by a transformation of the engine noise to a frequency domain.

10. The method according to claim 9, wherein, the phase of the engine noise and/or the phase of at least one oscillation existing in the engine noise is identified by at least one of a Fourier transform or a fast Fourier transform (FFT) and is based on sensor data.

11. The method according to claim 1, wherein the source signal comprises signal components that include a signal picked up before.

12. The method according to claim 1, wherein the source signal comprises synthetically generated signal components.

13. The method according to claim 12, wherein the source signal comprises synthetically generated signal components in a form of sinusoidal tones.

14. The method according to claim 1, wherein a level of an oscillation existing in the source signal is reduced if a frequency of this oscillation is close to a frequency of an undesirable resonance.

15. The method according to claim 1, wherein the source signal has a root mean square value of a voltage of at least 50% of a maximum voltage of the loudspeaker.

16. An exhaust system for an engine, in particular of a motor vehicle, comprising:

a loudspeaker and a controller, the controller being configured to provide a predetermined source signal for a desired additional sound in a time domain, the source signal comprising a plurality of signal components of different frequencies, analyze the source signal with respect to a phase of the source signal and/or a phase of at least one oscillation existing in the source signal, identify a phase of the engine noise and/or a phase of at least one oscillation existing in the engine noise, shift the phase of the source signal and/or the phase of the at least one oscillation existing in the source signal as a function of the phase as identified of the engine noise and/or of the phase as identified of the at least one oscillation existing in the engine noise to provide a phase-shifted source signal, a relationship of the phases of the individual oscillations of the source signal among each other being preserved, and generate the drive signal on the basis of the phase-shifted source signal; and wherein the controller drives the loudspeaker by the drive signal.

17. The exhaust system according to claim 16, including an exhaust branch and a microphone, the loudspeaker being in fluidic contact with the exhaust branch at a contact point, and the microphone being arranged upstream or downstream of the contact point.

18. A sound system of a motor vehicle, in particular for a passenger cell, comprising:

at least one loudspeaker and a controller, the controller being configured to provide a predetermined source signal for a desired additional sound in a time domain, the source signal comprising a plurality of signal components of different frequencies, analyze the source signal with respect to a phase of the source signal and/or a phase of at least one oscillation existing in the source signal, identify a phase of the engine noise and/or a phase of at least one oscillation existing in the engine noise, shift the phase of the source signal and/or the phase of the at least one oscillation existing in the source signal as a function of the phase as identified of the engine noise and/or of the phase as identified of the at least one oscillation existing in the engine noise to provide a phase-shifted source signal, a relationship of the phases of the individual oscillations of the source signal among each other being preserved, and generate the drive signal on the basis of the phase-shifted source signal; and the controller to drive the loudspeaker by the drive signal.

19. The sound system according to claim 18, wherein the loudspeaker is arranged inside or outside the passenger cell.

20. The sound system according to claim 19, wherein the sound system is part of a stereo and/or entertainment system of the motor vehicle.

* * * * *